United States Patent [19]

Skarsten

[11] 4,377,983

[45] Mar. 29, 1983

[54] DEVICE FOR APPLYING A LIQUID OR SEMILIQUID MEDIUM TO A WEB OF FLEXIBLE MATERIAL

[75] Inventor: Stephen R. Skarsten, Welwyn, England

[73] Assignee: Skarsten Manufacturing Co., Ltd., Welwyn Garden City, England

[21] Appl. No.: 175,429

[22] Filed: Aug. 5, 1980

[30] Foreign Application Priority Data

Feb. 5, 1980 [GB] United Kingdom ..... 8003880
Jun. 27, 1980 [GB] United Kingdom ..... 8021224

[51] Int. Cl.[3] ..... B05C 1/12

[52] U.S. Cl. ..... 118/42; 118/235; 118/246; 118/262; 118/DIG. 17

[58] Field of Search ..... 118/235, 246, 40, 42, 118/43, DIG. 17, 262

[56] References Cited

U.S. PATENT DOCUMENTS

| | | | |
|---|---|---|---|
| 387,793 | 8/1988 | McAfee | 118/246 X |
| 1,575,868 | 3/1926 | Roles | 118/DIG. 17 |
| 2,294,670 | 9/1942 | Krueger | 118/235 X |
| 4,244,320 | 1/1981 | McCurdy | 118/DIG. 17 |

FOREIGN PATENT DOCUMENTS

| | | | |
|---|---|---|---|
| 1180223 | 2/1970 | United Kingdom | 118/246 |
| 1184732 | 3/1970 | United Kingdom | 118/246 |

*Primary Examiner*—John P. McIntosh
*Attorney, Agent, or Firm*—Curtis, Morris & Safford

[57] ABSTRACT

A wallpaper pasting machine comprises a tray for the paste, rollers for transferring paste to the paper and guide means extending across the tray for training the paper over the rollers. The guide means are engaged by resilient side wall portions of the tray and are removable by deforming the side wall portions. A cutting template for guiding the cutting of the paper is also described.

9 Claims, 7 Drawing Figures

DEVICE FOR APPLYING A LIQUID OR SEMILIQUID MEDIUM TO A WEB OF FLEXIBLE MATERIAL

Figure 1:
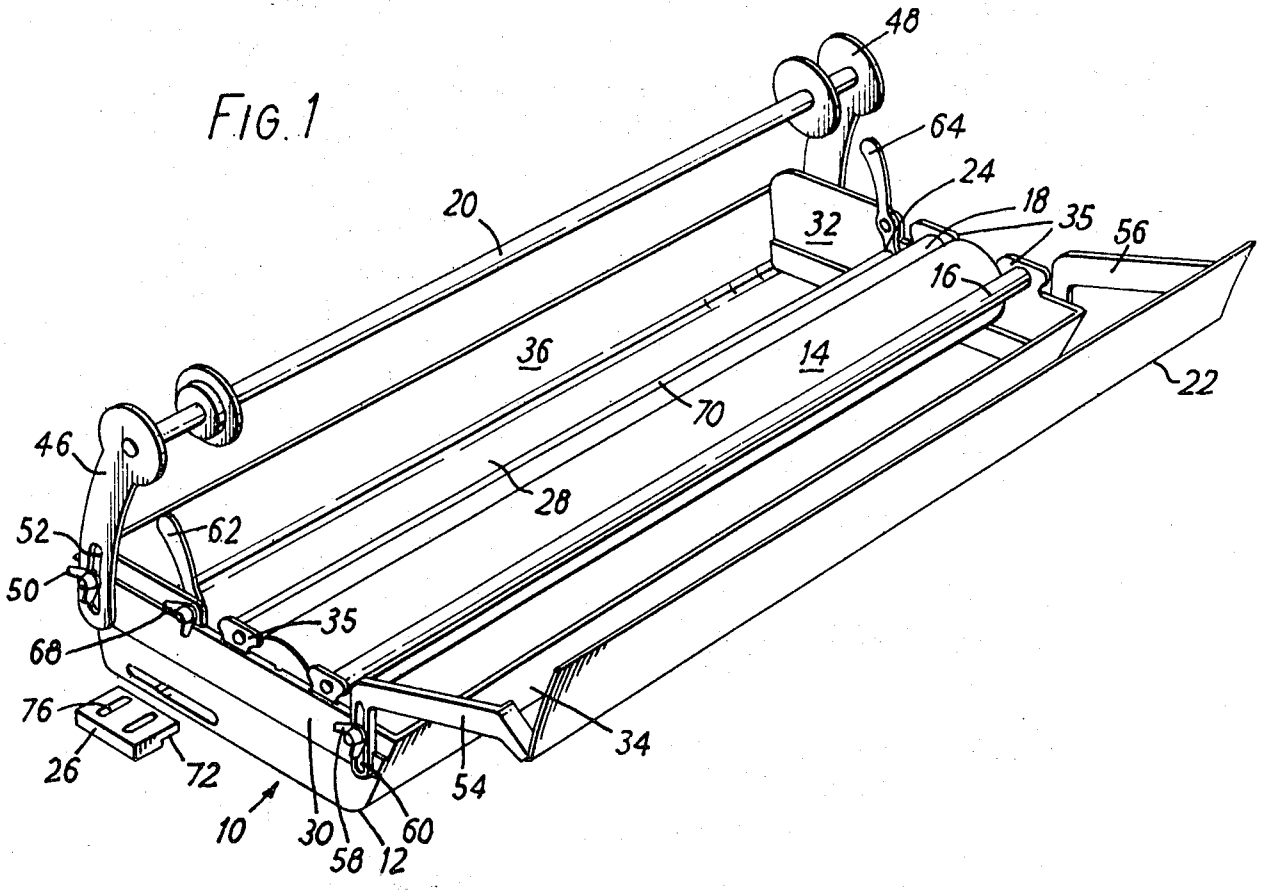

This invention relates to a device for applying a liquid or semi-liquid medium, for example wallpaper paste to a surface of a continuous web of flexible material, for example wallpaper.

In a previous construction of wallpaper pasting machine described in our U K Patent Specification No. 1,184,732 the paper is drawn from a roll and passes below two guide rollers which maintain the paper in contact with the top surface of an applicator roller dipping in a trough of paste located within the machine. Each of the rollers run on axles the ends of which are accommodated in slots or grooves formed in the side walls of the machine.

For cleaning purposes and also to facilitate threading of the web of wallpaper through the machine the guide rollers and the applicator roller are removable. In order to ensure that the guide rollers are maintained in a fixed location relative to the applicator roller a pivotable locking arm is provided on each side wall of the machine and these may be moved to positions in which the axles of the guide rollers are firmly clamped in position.

The previous construction described above suffers the disadvantages of being relatively complex to assemble and furthermore the sheet metal from which the body of the machine and the locking arms are constructed can easily become bent during use or transit and thus render the machine inoperable.

We have now developed an improved construction of device for applying a liquid or semi-liquid medium to a surface of a continuous web of flexible material.

According to one aspect of the present invention there is provided a device for applying a liquid or semi-liquid medium to a surface of a continuous web of flexible material, the device comprising a tray for receiving a supply of the medium, roller means for transferring medium from the supply to said surface and guide means for guiding the material so that in use a section thereof is trained over the roller means, the guide means comprising at least one removable elongate element adapted to extend across the tray generally parallel to the roller means with at least one end of said element engaged with a resilient side-wall portion of the tray, said element being releasable by deformation of said side-wall portion.

Various means may be employed for enabling the elongate element or elements to be releasably engaged with the corresponding resilient side wall portions of the tray. For example the elements may have axially extending studs which are accommodated in appropriate recesses or holes in the side wall portions of the tray. With one such arrangement the ends of the elongate elements may be engaged with the side wall portions of the tray by deforming the side wall portions outwardly so as to enable the ends of the studs to enter the recesses or holes where they are retained on release of the deforming force. The elongate elements are released by similar outward deformation of the side wall portions enabling the studs to leave the holes or recesses.

In another form of construction, slots or grooves are formed in the side walls of the tray and the ends of the elongate elements are accommodated in these slots or grooves. A detente or construction may then be provided in the walls of the slots or grooves to hold the elongate elements in their required positions. Removal of the elongate elements may be effected with this arrangement by forcing the elements in their direction of removal so as to deform the portion of the slot or groove wall providing the detente or constriction and enabling removal of the elongate elements.

Preferably the guide means comprise two elongate elements located on opposite sides of the roller means and arranged so that in use the web of flexible material passes under one of the elongate elements, over the roller means and under the other of the elongate elements. Preferably the elongate elements also consist of rollers. Most preferably the elongate elements consist of rollers having axle portions which are journalled in holes in the side-walls of the tray.

Although the supply of liquid or semi-liquid medium can be accommodated in a separate removal reservoir, it is preferred for the supply to be maintained within the tray itself.

A particularly convenient method of manufacturing devices according to the invention is to form the tray, including the aforesaid resilient side-wall portions, as a one-piece moulding, stamping or pressing of a suitably resilient material, for example a plastics material such as high density polyethylene or polypropylene, or a sufficiently resilient grade of compressed, waxed paper.

Preferably devices according to the invention are provided with support means for supporting a roller of the flexible material in relation to the guide means so that flexible material drawn from the roller follows a predetermined path from the roll to guide means. In order to accommodate rolls of different diameters the support means is preferably adjustable so that the position of the axis of the roll relative to the remainder of the device may be altered.

For example the roller support means may be attached to the remainder of device by means of a clamping bracket having a straight or curved slot formed therein so that the roll support means may be clamped at a variety of positions along the slot. The use of a curved slot can be particularly advantageous since it enables the roll support to be arranged so that the centre of the roll lies at various locations on a curved path. With this arrangement, the roll support can be arranged so that relatively heavy rolls of material can be held at a location which is located more directly above the centre of the tray.

In a preferred embodiment of devices according to the invention a spreader element is provided for spreading a uniform layer of the liquid or semi-liquid medium over the surface of the roller means. Preferably the spreader element comprises an elongate bar or roller mounted at each end on a respective arm pivotally connected to the device so that the position of the spreader element relative to the roller means may be adjusted. Preferably the position of each end of the spreader element is independently adjustable so that the thickness of the layer of medium may be varied along the length of the roller means.

Devices according to the invention are preferably provided with an adjustable guide arranged generally at right angles across the web of flexible material and providing a cutting template which is adjustable vertically relative to the device enabling the material to cut along a line which is displaced by a predetermined distance from the position at which the device is located. Wallpaper pasting machines incorporating such adjustable guides are novel and form a further aspect of the invention.

Thus according to a further aspect of the invention, there is provided a device for applying a liquid or semi-liquid medium to a surface of a continuous web of flexible material, said device comprising a reservoir for a supply of medium, means for transferring medium from the reservoir to one side of material drawn continuously from a roll thereof and a guide arranged generally at right angles across the web of material and providing a cutting template enabling the material to be cut transversely at right angles to its length and wherein the position of the guide is adjustable relative to the remainder of the device to enable the material to be cut along a line which is displaced by a predetermined distance from the position at which the device is located.

For example in the case of a wallpaper pasting machine, the guide may be arranged so that when the machine is stood on the floor of a room at a predetermined distance from a section of wall to which wallpaper is being applied and the wallpaper is cut along a line corresponding to the template, the lower edge of the cut length of wallpaper will line exactly along the intended lower margin of the papered area of the wall, e.g. along the top of the skirting board.

Figure 2:
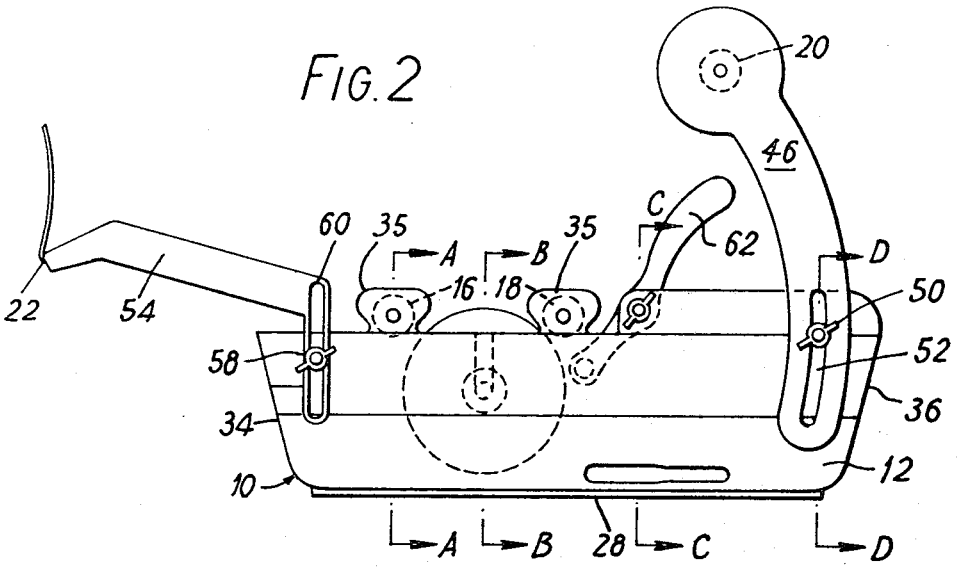
Figure 2A:
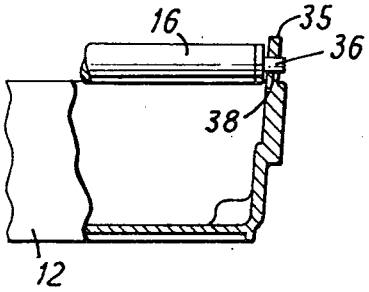
Figure 2B:
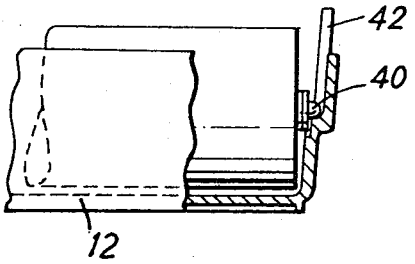
Figure 2C:
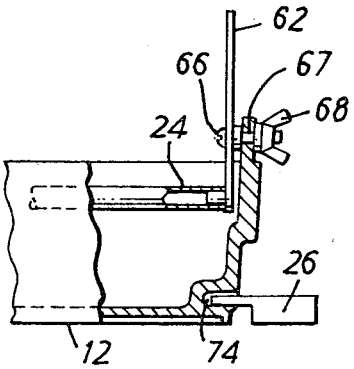
Figure 2D:
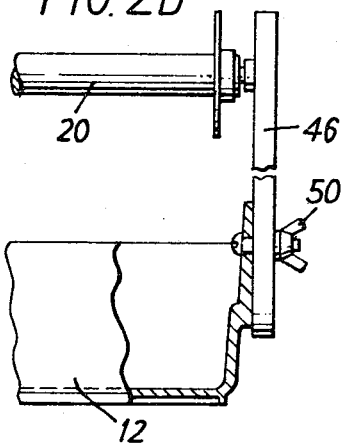

This invention will now be described in more detail by way of example with particular references to the accompanying drawings of which FIG. 1 is a side elevation of a wallpaper pasting machine;

FIG. 2 is a plan view of the machine of FIG. 1

FIGS. 2A–D are transverse cross sections on lines A, B, C and D on FIG. 2, and

Figure 3:
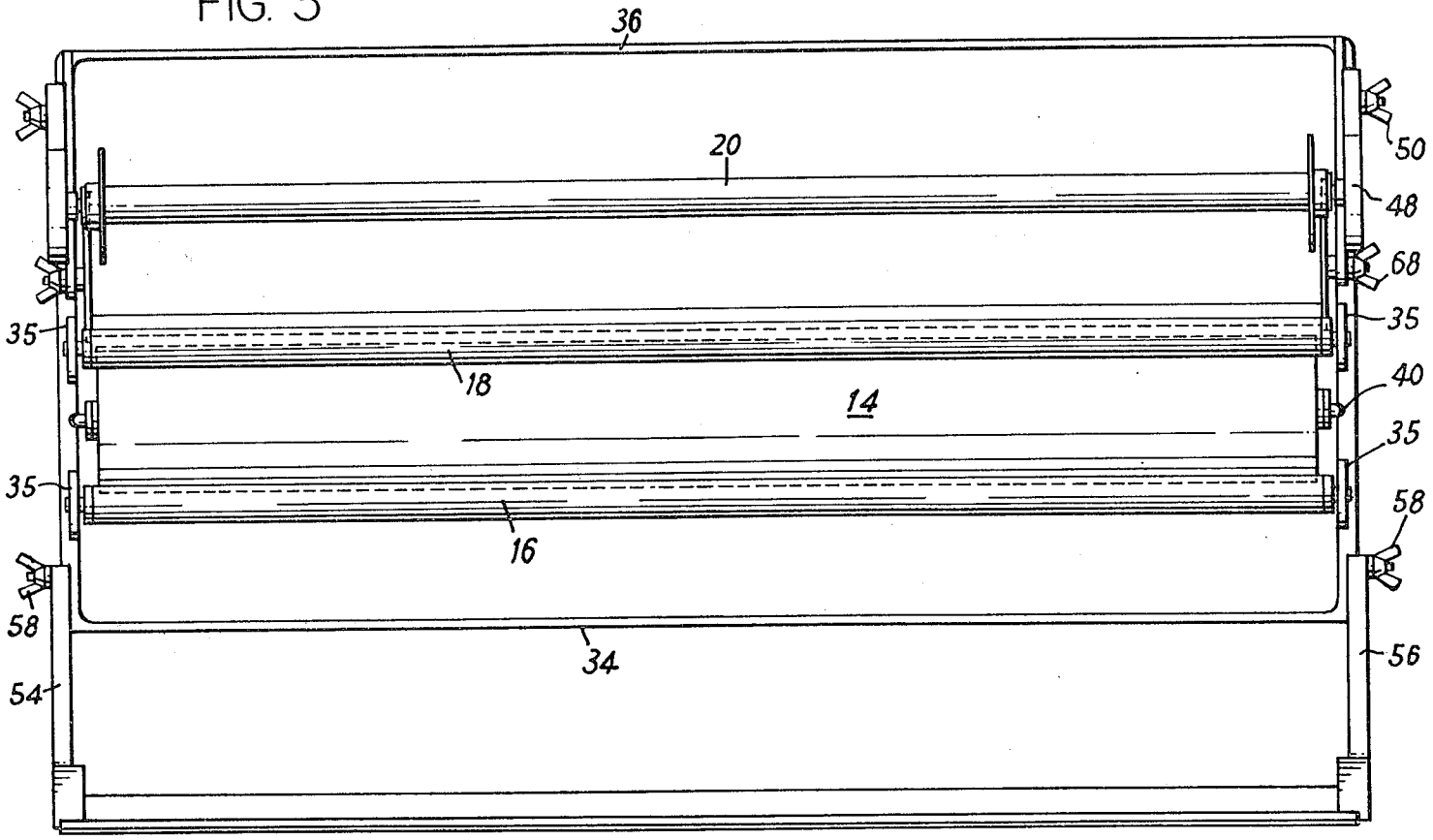

FIG. 3 is a perspective view of the machine of FIG. 1.

Referring to the drawings wallpaper pasting machine 10 comprises a tray 12 formed as a one-piece moulding from high density polypropylene, an applicator roller 14, two guide rollers 16 and 18, a supporting bar 20 for carrying a roll of wallpaper to be pasted, a cutting template 22, a spreader bar assembly 24 and locating feet 26.

Tray 12 consists of a base 28, side walls 30 and 32 and front and back walls 34 and 36. On the upper margins of side walls 30 and 32 are provided pairs of upwardly extending tongues 35 which acts as supports for guide rollers 16 and 18. The guide rollers are provided at each end with axle stubs 36 which are journalled in holes 38 in tongues 35. Since the side walls of the tray and the tongues are formed from a relatively flexible grade of polypropylene the guide rollers may be removed from their mounting holes 38 by simply flexing the tongues outwards.

Applicator roller 14 is similarly provided with axle stubs 40 which are accommodated as a loose fit in grooves 42 and 44 on the inner faces of side walls 30 and 32.

Supporting bar 20 is attached to the tray adjacent the back wall 36 by a pair of support brackets 46 and 48. The support brackets are clamped to the tray side walls by wing nuts 50 which are screwed on screws passing through holes in the side walls of the tray and elongate arcuate slots 52 in the support brackets.

Cutting template 22, which is generally L-shaped in transverse cross-section, and which is formed of sheet metal, but which may be made of a plastics material, is attached to the tray adjacent the front wall 34 by a pair of moulded plastics struts 54 and 56. The struts, which are also generally L-shaped are clamped to the tray side-walls by wing nuts 58 which are screwed on screws passing through holes in the side walls of the tray and elongate slots 60 extending along one arm of each of struts 54 and 56.

Spreader bar assembly 21 consists of side arms 62 and 64 pivotally mounted on screws 66 which pass through holes 67 in the side walls of the tray. Wing nuts 68 are screwed onto the screws to enable the side arms to be clamped in a desired position. A roller 70 extends across the tray between corresponding ends of the side arms.

In use of the wallpaper pasting machine, a supply of wallpaper paste is introduced into the tray to a depth sufficient to cover the lower portion of applicator roller 14. A roll of wallpaper is fitted onto supporting bar 20 and guide rollers 16 and 18 are removed by flexing tongues outwardly until the axle studs 36 are released from holes 38.

Wallpaper is then pulled from the roll and draped over applicator roller 14. Guide rollers 16 and 18 are then relocated in holes 38 by flexing tongues 35 outwardly. The guide rollers 16 and 18 cause a portion of the wallpaper to conform to the upper surface of the applicator roller 14.

If the free end of the wallpaper is then pulled to the left (FIG. 2) wallpaper is fed from the roll, under guide roller 18, over applicator roller 14 and under guide roller 16. Applicator roller 14 is rotated counter-clockwise (FIG. 2) by the wallpaper and paste is picked up by the applicator roller and deposited on the under-side of the wallpaper. The thickness of the paste film on the applicator roller and hence the thickness of the paste film applied to the paper may be adjusted by altering the position of spreader roller 70.

The positions of the side arms 62 and 64 of spreader bar assembly 24 may be adjusted independently and consequently the spreader roller may be arranged so as to leave a tapering gap between the spreader roller and the applicator roller. With this arrangement the machine can apply a film of paste which differs in thickness across the width of the paper if desired.

Wallpaper pasted by the machine may be applied directly to the walls to be papered. In such cases it is advantageous to stand the machine on the floor directly in front of the section of wall being papered. Pasted paper may be drawn from the machine and pressed into position on the wall, starting at the upper part of the wall. The height of the cutting template 22 may be adjusted so that when the paper is cut using the lower margin of the template as a guide, the cut edge of the paper fits exactly to the lower edge of the desired papered area of the wall, e.g. to the skirting board.

If desired, the wallpaper pasting machine may be clamped firmly to the surface on which it is located by inserting tongues 72 of feet 26 into corresponding slots 74 formed in the side walls of the tray. The feet themselves may then be screwed to the surface on which the machine is located by screws passing through slots 76.

Tray 12 may be formed from materials other than the high density polypropylene referred to above. For example other plastics moulding materials may be used or the tray may be formed as a pressing from waxed compressed paper or similar materials.

I claim:

1. A device for applying a liquid or semi-liquid medium to a surface of a continuous web of flexible wall covering material, the device comprising a tray of resilient plastics material for receiving a supply of the medium, the tray having a base on which to rest, roller means for transferring medium from the supply to said surface, guide means for guiding the web of flexible material so that in use a section thereof is trained over the roller means, the guide means comprising at least one removable elongate element adapted to extend across the tray generally parallel to the roller means, said elongate element being rotatably mounted in opposing side wall portions of the tray, said element being releasable by resiliently deforming at least one of said side wall portions outwardly, and template means which in use is arranged to lie generally parallel to the roller and guide means, providing a template along which to cut the web of flexible material, means being provided for adjusting the template means to one of a number of positions relative to the tray and securing the template means in said position, the arrangement enabling the web of flexible material to be cut along a line which is displaced by a vertical distance from the plane of the base of the tray determined by said template position.

2. A device according to claim 1 wherein the guide means comprises two elongate elements located on opposite sides of the roller means and arranged so that in use the web of flexible material passes under one of the elongate elements, over the roller means and under the other of the elongate elements.

3. A device according to claim 2 wherein the elongate elements consist of rollers having axle portions which are journalled in holes in the side-walls of the tray.

4. A device according to claim 1 wherein the tray forms a reservoir for receiving the supply of liquid or semi-liquid medium.

5. A device according to claim 1 wherein the tray comprises a one-piece moulding, pressing or stamping of resilient plastics material.

6. A device according to claim 1 including support means for supporting a roll of the flexible material in relation to the guide means so that flexible material drawn from the roll follows a predetermined path from the roll to the guide means.

7. A device according to claim 6 wherein the support means is adjustable so that the position of the axis of the roll relative to the remainder of the device may be altered.

8. A device according to claim 7 wherein the support means is constructed so as to enable the centre of the roll to lie at various locations on a curved path.

9. A device according to claim 1 including a spreader element for spreading a layer of the liquid or semi-liquid medium over the surface of the roller means, the spreader element comprising an elongate bar or roller mounted at each end on a respective arm pivotally connected to the device so that the position of each end of the spreader element is independently adjustable so that the thickness of the layer of medium may be varied along the length of the roller means.

* * * * *